US005788456A

United States Patent [19]

Maier

[11] Patent Number: 5,788,456

[45] Date of Patent: Aug. 4, 1998

[54] TURBINE DIAPHRAGM ASSEMBLY AND METHOD THEREOF

[75] Inventor: William C. Maier, West Almond, N.Y.

[73] Assignee: Dresser-Rand Company, Corning, N.Y.

[21] Appl. No.: 803,203

[22] Filed: Feb. 21, 1997

[51] Int. Cl.[6] ..... F01D 1/02

[52] U.S. Cl. ..... 415/190; 415/209.2; 415/209.4; 415/189; 29/889.22

[58] Field of Search ..... 415/209.2, 208.1, 415/209.4, 210.1, 209.3, 209.1, 189, 190, 191; 29/889.21, 889.22

[56] References Cited

U.S. PATENT DOCUMENTS

| | | | |
|---|---|---|---|
| 1,740,800 | 12/1929 | Wiberg | 29/889.21 |
| 2,299,449 | 10/1942 | Allen | 29/889.22 |
| 2,905,434 | 9/1959 | Hertl | 415/209.2 |
| 3,313,520 | 4/1967 | Ortolano et al. | 415/209.4 |
| 3,447,741 | 6/1969 | Havette et al. . | |
| 3,788,767 | 1/1974 | Bednarczyk et al. | 415/209.4 |
| 3,932,056 | 1/1976 | Tai . | |
| 4,195,396 | 4/1980 | Blazek . | |
| 4,288,677 | 9/1981 | Sakata et al. . | |
| 4,509,238 | 4/1985 | Lee et al. . | |
| 4,566,166 | 1/1986 | Donelson . | |
| 4,710,097 | 12/1987 | Tinti . | |
| 4,710,099 | 12/1987 | Matsuura . | |
| 5,074,749 | 12/1991 | Fouillot et al. . | |
| 5,226,789 | 7/1993 | Donges . | |
| 5,586,864 | 12/1996 | Knorowski et al. | 415/209.2 |

*Primary Examiner*—Thomas E. Denion
*Assistant Examiner*—Richard Woo
*Attorney, Agent, or Firm*—Nixon, Hargrave, Devans & Doyle LLP

[57] ABSTRACT

A turbine diaphragm assembly includes inner and outer endwall rings, nozzle vanes each with a tenon extending outwardly from one end, and inner and outer retaining rings. The inner and outer endwall rings each have inner and outer radial surfaces and a plurality of openings extending radially through the inner and outer endwall rings about their circumference. Each of the vanes is positioned between the inner and outer endwall rings, with one of the tenons protruding radially inward through one of the openings in the inner endwall ring and with the other tenon protruding radially outward through one of the openings in the outer endwall ring. The inner radial surface of the inner endwall ring is located adjacent to the outer radial surface of the inner retaining ring with the portion of the tenons protruding radially inward through the openings in the inner endwall ring and positioned in a first circumferential groove in the outer radial surface of the inner retaining ring. The outer radial surface of the outer endwall ring is located adjacent to the inner radial surface of the outer retaining ring with the portion of the tenons protruding radially outward through the openings in the outer endwall ring and positioned in a second circumferential groove in the inner radial surface of the outer retaining ring.

18 Claims, 8 Drawing Sheets

TURBINE DIAPHRAGM ASSEMBLY AND METHOD THEREOF

FIELD OF THE INVENTION

The present invention relates generally to a turbine and, more particularly, to a diaphragm assembly for a turbine.

BACKGROUND OF THE INVENTION

Referring to FIGS. 1–3, a prior art diaphragm assembly 10 for a turbine is illustrated. The diaphragm assembly 10 includes nozzle vanes 12, inner and outer endwall rings 14 and 16, and inner and outer retaining rings 18 and 20. The nozzle vanes 12 each have an opposing pair of radially oriented ends 22 which are substantially flush with the outer radial surface of the outer endwall ring 16 and the inner radial surface of the inner endwall ring 14. The nozzle vanes 12 also each have an opposing pair of faces 24. The inner and outer endwall rings 14 and 16 each have an inner radial surface 26 and 28, respectively, and an outer radial surface 30 and 32, respectively, and also have a series of nozzle vane shaped openings 34 spaced around their circumference.

As shown in FIG. 1, the nozzle vanes 12 are positioned in the openings 34 in the inner and outer endwall rings 14 and 16 so that one end 22 of each nozzle vane 12 is substantially flush with the inner surface 26 of inner endwall rings 14 and the other end 22 of each vane 12 is substantially flush with the outer surface 32 of outer endwall ring 16. Once the nozzle vanes 12 are in place, the vanes 12 are fully welded around the edge (shown by shaded areas 39) to the inner and outer endwall rings 14 and 16 to form a flowpath assembly 36. Next, the flowpath assembly 36 is placed between the inner and outer retaining rings 18 and 20 and is either deep penetration welded (shown by shaded areas 38 in FIG. 3) or is bolted in place (not shown).

The prior art diaphragm assembly 10 discussed above has several problems. One of the main problems is with the cost and time involved in its manufacture. Extensive welds 38 and 39 are needed to secure the nozzle vanes 12 in place and this type of labor intensive process adds to the cost and time of constructing the assembly 10.

Another problem with the prior art diaphragm assembly 10 is with the welds themselves. The welds used to secure the nozzle vanes 12 to the endwall rings 14 and 16 often extend beyond the outer radial surface 32 of the outer endwall ring 16 or the inner radial surface 26 of the inner endwall ring 14 interfering with the assembly of the flowpath sub-assembly to the inner and outer retaining rings 18 and 20. Also, if the welds are too large they may melt through the endwall rings 14 and 16 causing unacceptable roughness in the flowpath. Additionally, the welds often are subject to significant steady and unsteady loads which can lead to fatigue and cracking causing the nozzle vanes 12 to dislodge.

Yet another problem with the prior art diaphragm assembly 10 relates to the treatment of the split. Often, especially in steam turbines, the diaphragm assembly 10 must be split into two halves so that the diaphragm assembly 10 can be installed around the shaft. The cutting and refitting of the diaphragm assembly 10 is difficult and expensive. Typically, some type of "keying" must be added to accurately align the two halves.

SUMMARY OF THE INVENTION

A turbine diaphragm assembly in accordance with the present invention includes inner and outer endwall rings, a plurality of nozzle vanes, a plurality of tenons, and inner and outer retaining rings with circumferential grooves which mate with the tenons. The inner endwall ring has inner and outer radial surfaces and a plurality of openings extending radially through the inner endwall ring about its circumference. The outer endwall ring has inner and outer radial surfaces and a plurality of openings extending radially through the outer endwall ring about its circumference. Each of the tenons has substantially the same shape and extends outwardly from one of the opposing ends of one of the vanes. Each of the vanes has two opposing ends and is positioned between the inner and outer endwall rings, with one of the tenons protruding radially inward through one of the openings in the inner endwall ring and with the other tenon protruding radially outward through one of the openings in the outer endwall ring. The inner retaining ring has inner and outer radial surfaces with the outer radial surface of the inner retaining ring having a first circumferential groove. The outer retaining ring has inner and outer radial surfaces, with the inner radial surface of the outer retaining ring having a second circumferential groove. The inner radial surface of the inner endwall ring is located adjacent to the outer radial surface of the inner retaining ring with the portion of the tenons protruding radially inward through the openings in the inner endwall ring positioned in the first circumferential groove. The outer radial surface of the outer endwall ring is located adjacent to the inner radial surface of the outer retaining ring with the portion of the tenons protruding radially outward through the openings in the outer endwall ring positioned in the second circumferential groove.

More specifically, in one embodiment of the diaphragm assembly the nozzle vanes are positioned between the endwall rings through appropriately shaped holes circumferentially arrayed around the endwall rings with tenons protruding radially inward from the inner endwall ring and radially outward from the outer endwall ring forming a flowpath sub-assembly. The shaped inner and outer flowpath sub-assembly tenons mate with matching surfaces on the inner and outer retaining rings. In this embodiment, the mating surfaces of the inner and outer retaining rings have circumferential grooves in them to receive the tenons of the flowpath sub-assembly. The mechanical interface of the tenons and grooves is used to structurally hold the diaphragm assembly together axially, and to withstand any axial forces imposed on it.

Both the flowpath sub-assembly and the retaining rings are split into halves. The retaining rings are split flat in an axial-radial plane while the flowpath sub-assembly is split along a line half way between adjacent nozzle vanes at circumferentially opposite sites. The flowpath sub-assembly is offset circumferentially relative to the retaining rings giving a small amount of the flowpath sub-assembly extending circumferentially beyond the split line of the retaining rings and withdrawn a matching amount at the other side of the diaphragm half. Because of the precise nature of the tenon and groove shapes, this circumferential extension forms an effective radial alignment mechanism at the diaphragm split when assembled with the other diaphragm assembly half. Small circumferential seal welds at the radial interface between the endwall rings and the retaining rings on the upstream and downstream faces of the diaphragm assembly fixes the "clocking" of the flowpath assembly relative to the retaining rings and eliminates the possibility of leakage around the flowpath assembly.

The diaphragm assembly in accordance with the present invention provides several advantages over existing diaphragm assemblies. One of the main advantages with the diaphragm assembly is that it can be manufactured more easily and cheaply than prior diaphragm assembles. For example, the labor intensive process of deep penetration welding or welding around the complex shape of the nozzle vanes used with prior diaphragm assemblies is unnecessary. Additionally, the diaphragm assembly does not have any welds protruding into the flowpath which could disrupt the flow of fluid in the assembly because deep penetration welds are unnecessary with the tenon and groove arrangement. Further, the nozzle vanes are less likely to break off because the tenon and groove arrangement in the diaphragm assembly is better able to withstand the loads placed on the vanes than the deep penetration welds.

Even further, alignment of the diaphragm assembly is more precise and easier than with prior diaphragm assemblies. The flowpath sub-assembly of the current invention is rotated before seal welding so that a portion of the sub-assembly extends out from the half. The portion with extends out is mated into the grooves in the other half of the diaphragm assembly to ensure proper alignment. Since most prior art diaphragms have the flowpath flush with the split of the inner and outer retaining rings such an alignment technique is not possible. The machined tenon and groove interface of the present invention assures precise axial and lateral alignment.

DETAILED DESCRIPTION

Figure 1:
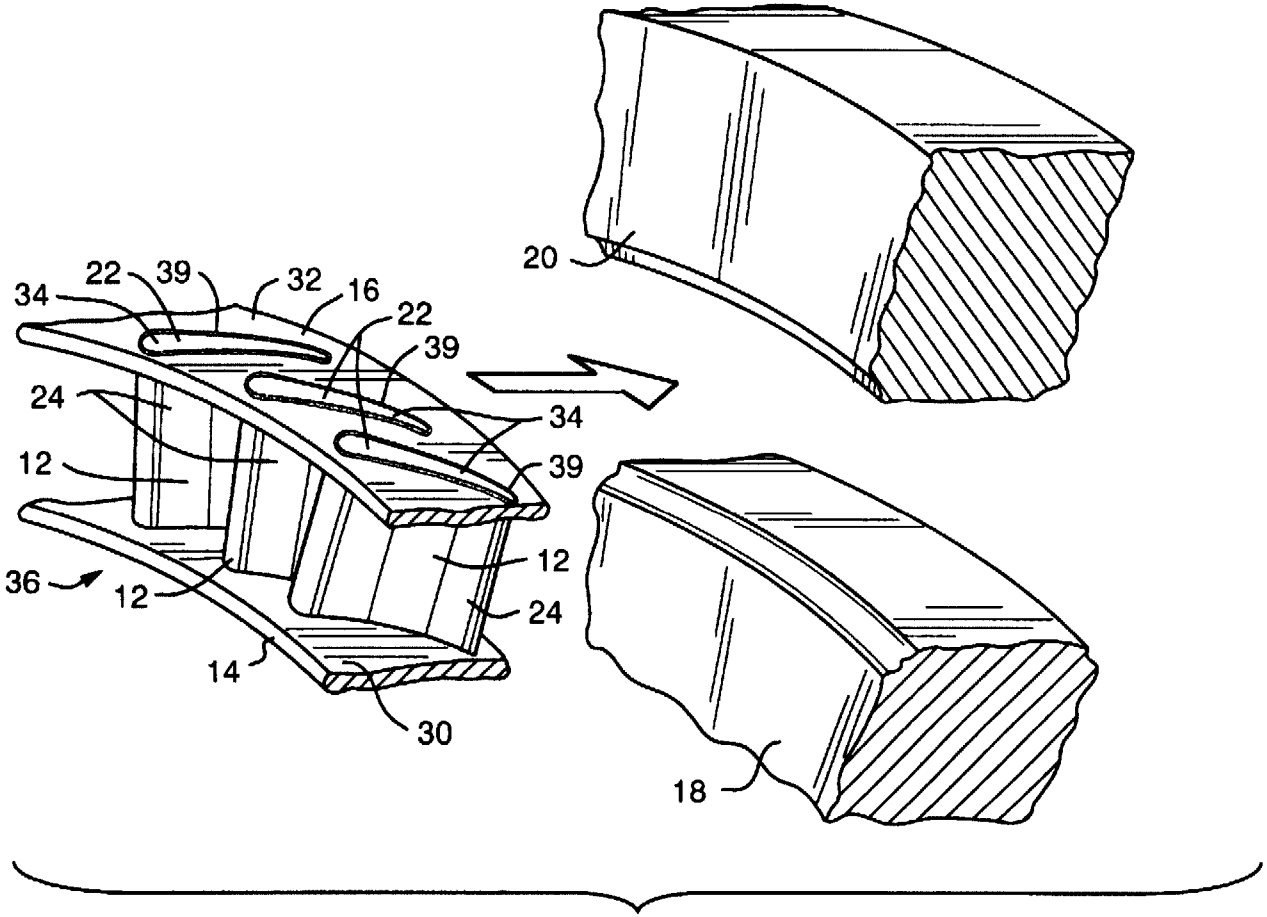
FIG. 1 (PRIOR ART)
FIG. 1 is an exploded, perspective view of a prior art flowpath assembly.
Figure 2:
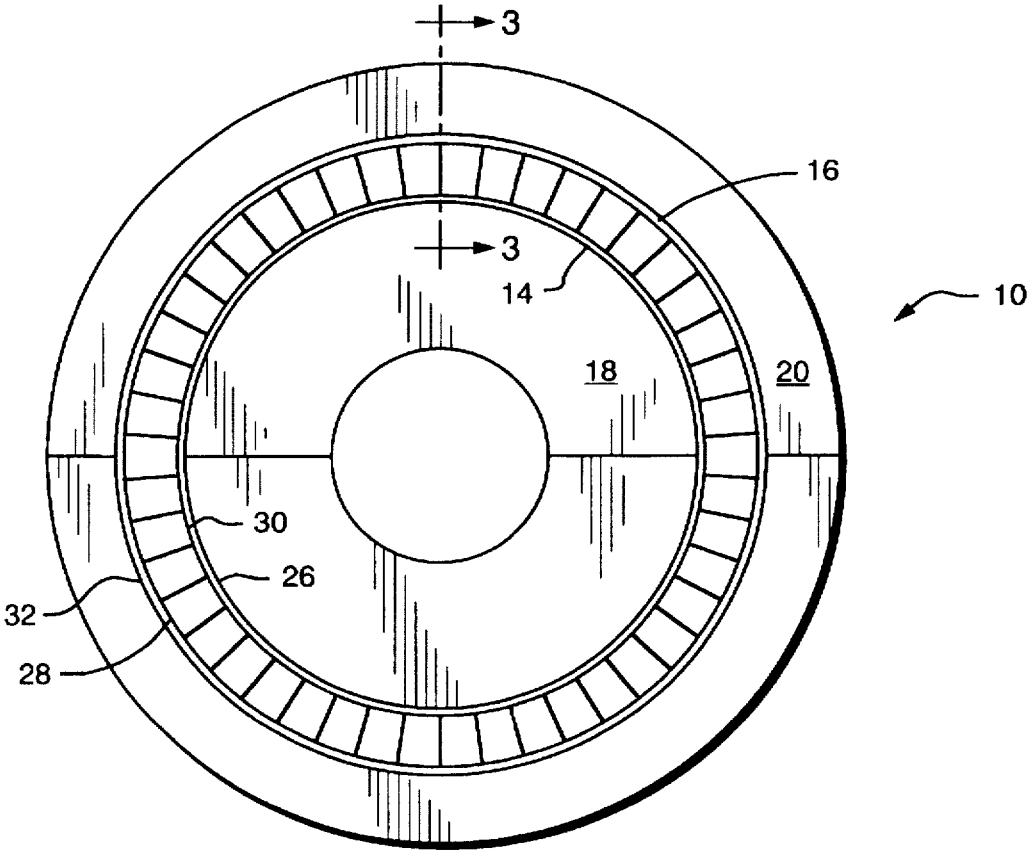
FIG. 2 (PRIOR ART)
FIG. 2 is a cross-sectional view of the prior art diaphragm assembly.
Figure 3:
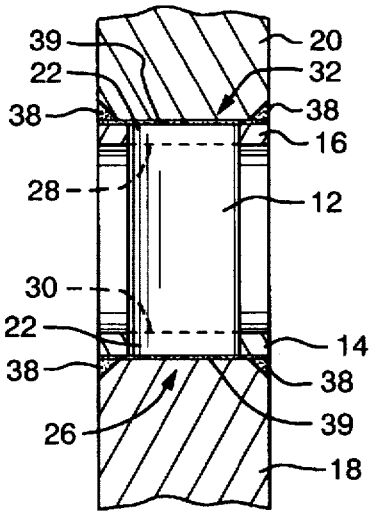
FIG. 3 (PRIOR ART)
FIG. 3 is a side, cross-sectional view of the prior art diaphragm assembly taken along line 3—3 in FIG. 2.

A diaphragm assembly 40 in accordance with the present invention is illustrated in FIGS. 4–10B. The diaphragm assembly 40 includes nozzle vanes 42, tenons 44, inner and outer endwall rings 46 and 48, and inner and outer retaining rings 50 and 52 each with a circumferential groove 54. The diaphragm assembly 40 can be constructed more easily and cheaply, is more sturdy, and is easier to realign during installation than prior diaphragm assemblies 10.

Figure 5:
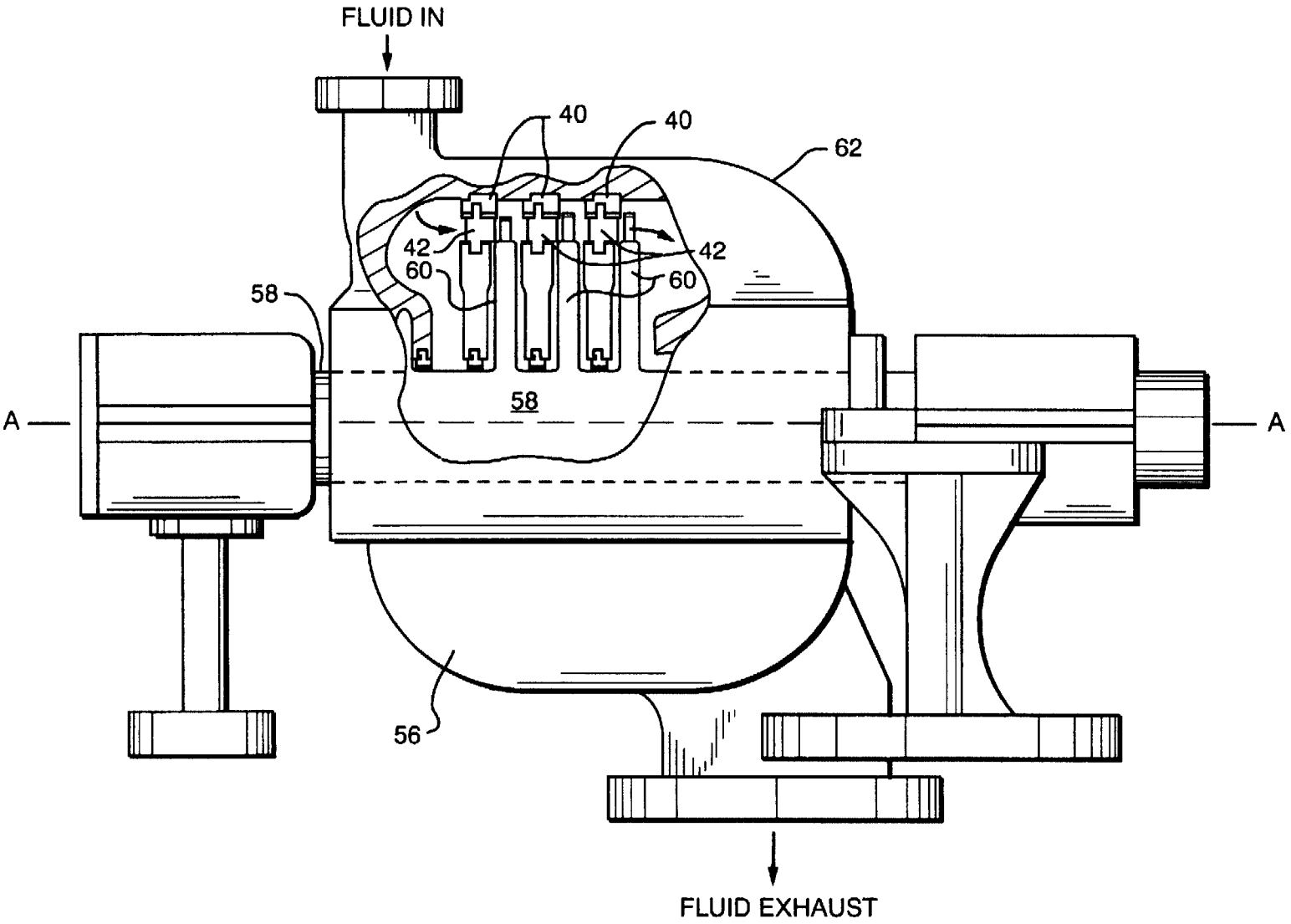
FIG. 5 is a partially, broken away side view of a turbine with a diaphragm assembly in accordance with the present invention.

Referring to FIG. 5, a turbine 56 with the diaphragm assembly 40 in accordance with the present invention is illustrated. The turbine 56 includes a shaft 58 that extends along and rotates about a central axis A with rotor wheels 60 mounted on the shaft 58 and extending radially outward from the central axis. Diaphragm assemblies 40 are located in a turbine case 62 which surrounds the rotor wheels 60 and diaphragm assemblies 40. The diaphragm assemblies 40 are axially spaced from the rotor wheels 60 and extend radially inward from the turbine casing 62. Basically, the diaphragm assemblies 40 direct fluid against and effect rotation of the rotor wheels 60.

Figure 4C:
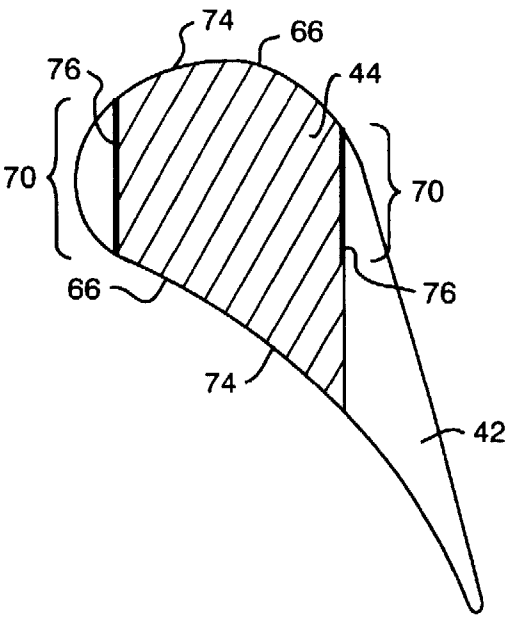
FIGS. 4(*a*–*c*) are cross-sectional views of a prior art nozzle vane and a nozzle vane in accordance with the present invention.
Figure 4B:
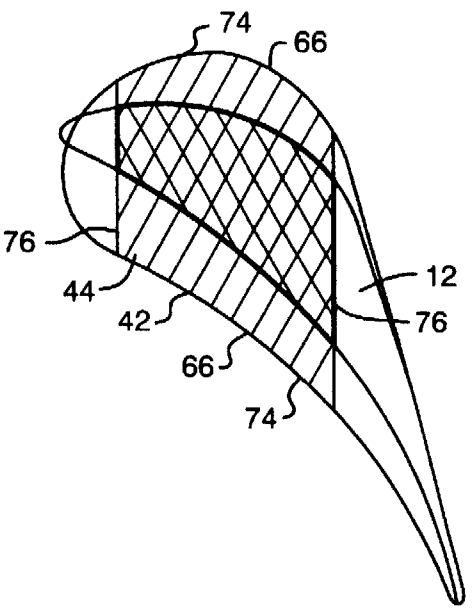
Figure 4A:
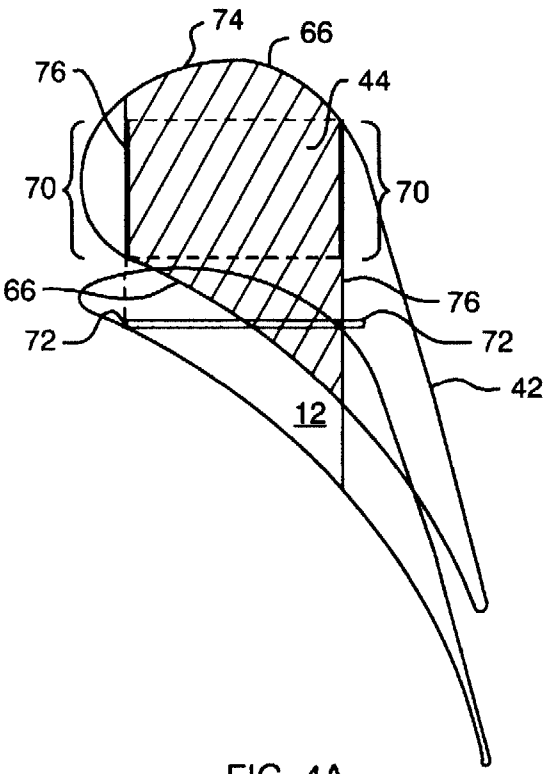

Referring to FIGS. 4(*a*–*c*), 6, 9, 10A, and 10B, diaphragm assembly 40 includes nozzle vanes 42. Each nozzle vane 42 has a pair of opposing ends 64 and a pair of opposing faces 66. The length of each nozzle vane 42 is longer than the radial distance or width between the inner and outer endwall rings 46 and 48. As a result, when the nozzle vanes 42 are installed, ends 64 of each nozzle vane 42 extends past the inner and outer endwall rings 46 and 48, respectively. The ends 64 of each nozzle vane 42 are machined to form tenons 44.

Referring to FIGS. 4(*a*–*c*), a comparison of a prior art nozzle vane 12 and a nozzle vane 42 in accordance with the present invention is illustrated. As shown in FIG. 4(*b*), prior art nozzle vane 12 has a substantially smaller cross-sectional area and width than nozzle vane 42. In this particular embodiment, the nozzle vane 12 has a cross-sectional area of about 0.35 $in^2$ and nozzle vane 42 has a cross-sectional area of about 0.75 $in^2$. With the larger cross-sectional area, nozzle vane 42 has a significantly higher bending strength than the prior art nozzle vane 12. Additionally, nozzle vane 42 has an axial contact surface area 70 which is normal to axial forces (indicated by the arrow AF) that is at least eight times as large as the axial contact surface area 72 for nozzle vane 12. The larger axial contact surface area for nozzle vane 42 enables the tenons 44 to be formed, thus allowing the nozzle vane 42 to better withstand the fluid pressure when the turbine 56 is in operation so that the nozzle vane 42 does not dislodge.

Figure 6:
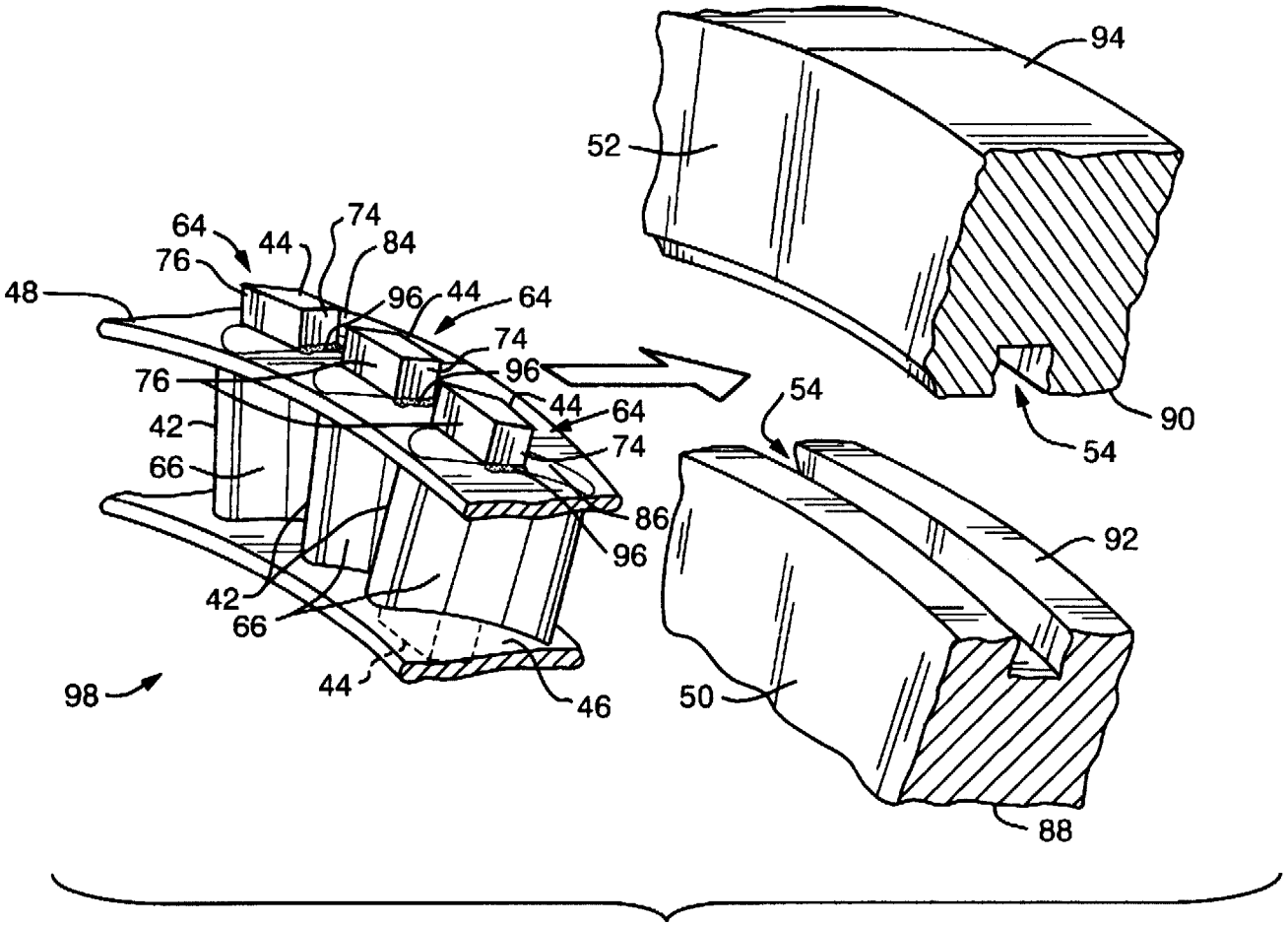
FIG. 6 is an exploded, perspective view of a flow path assembly.
Figure 9:
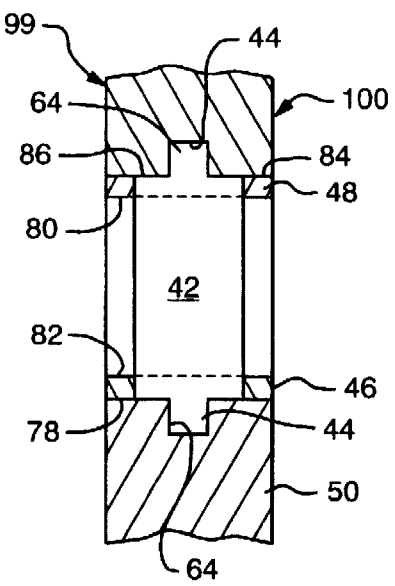
FIG. 9 is an enlarged, cross-sectional view taken along radial line 9—9 in FIG. 7.

Referring to FIGS. 6 and 9, each nozzle vane 42 has a tenon 44 extending from each end 64 of each nozzle vane 42. Each tenon 44 has substantially the same shape and has a pair of opposing faces 76 oriented perpendicular to the machine rotational center line A—A and a pair of opposing sides 74 which are substantially perpendicular to faces 76 in this embodiment. Additionally, in this particular embodiment, each tenon 44 has a substantially trapezoidal shape, although the shape of each tenon 44 can vary as needed and desired. The width or distance between the opposing faces 76 of each tenon 44 is about the same or slightly less than the width of the groove 54 in inner and outer retaining rings 50 and 52. Preferably, the width of tenon 44 is set to fit snugly within grooves 54 in inner and outer retaining rings 50 and 52. In this particular embodiment, each groove 54 has an axial width of about ⅝" and each tenon 44 has an axial width (between faces 76) a few thousandths of an inch less than about ⅝" so that tenons 44 fit snugly in groove 54, although the width can vary as needed. The opposing sides 74 of each tenon 44 are substantially flush with the opposing faces 66 of each nozzle vane 42.

The size of each tenon 44 (i.e. extending between opposing sides 74 and between opposing faces 76) adds to its overall strength and durability. The shape of the nozzle vane 42 and the relative position of the tenon 44 are configured to maximize the section modulus of the tenon 44 while having little or no impact on the aerodynamics of the diaphragm flowpath. This is accomplished in this embodiment by extending the circumferential thickness of the vanes 42 in their upstream portion, i.e. between sides 74 of tenons 44. Here, because of low flow velocities the reduction in flow area due to the thicker nozzle vane 42 has a minimal performance impact. The added benefit of reduced incidence sensitivity is also secured.

Referring to FIGS. 6–7, 9, 10A, and 10B, diaphragm assembly 40 also includes inner and outer endwall rings 46 and 48. Inner and outer endwall rings 46 and 48 each have an inner radial surface 78 and 80, respectively, and an outer radial surface 82 and 84, respectively. The inner and outer endwall rings 46 and 48 also have a plurality of openings 86 spaced around their circumference. In this particular embodiment, each opening 86 has substantially the same shape as the cross-sectional shape of the nozzle vane 42 shown in FIGS. 4(*a–c*), although the shape of the opening 86 can vary as needed or desired.

Diaphragm assembly 40 also includes inner and outer retaining rings 50 and 52. Inner and outer retaining rings 50 and 52 each have an inner radial surface 88 and 90, respectively, and outer radial surface 92 and 94, respectively. Outer radial surface 92 of inner retaining ring 50 includes a circumferential groove 54 and the inner radial surface 90 of the outer retaining ring 52 includes a circumferential groove 54. The grooves 54 are designed to receive the tenons 44 extending from each end of the nozzle vanes 42. In this particular embodiment, the circumferential grooves 54 are continuous around the outer radial surface 92 of the inner retaining ring 50 and continuous around the inner radial surface 90 of the outer retaining ring 52, although the grooves 54 could be discontinuous, if needed or desired. Additionally in this particular embodiment, each of the grooves 54 and tenons 44 has a substantially rectangular shape as shown in the cross-sectional view in FIG. 9. The shape of the grooves 54 and tenons 44 can vary as needed or desired, as long as the shapes of grooves 54 and tenons 44 mate.

The diaphragm assembly 40 is constructed by first inserting the nozzle vanes 42 in each of the openings 86 in the inner and outer endwall rings 46 and 48. As discussed earlier, the nozzle vanes 42 have a length greater than the distance or width between the inner and outer endwall rings 46 and 48. As a result, when the nozzle vanes 42 are positioned in the openings 86, one end 64 of each nozzle vane 42 extends out from the opening 86 past the inner surface 78 of the inner endwall ring 46 and the other end 64 of each nozzle vane 42 extends out from the opening 86 past the outer surface 84 of the outer endwall ring 48.

Next, each nozzle vane 42 is welded in place by putting a small weld 96 between each face 66 and side 74 of one end 64 of each nozzle vane 42 and the inner radial surface 78 of the inner endwall ring 46 and a small weld 96 between each face 66 and face 74 of the other end 64 of each nozzle vane 42 and the outer radial surface 84 of the outer endwall ring 48, as shown by the shaded areas 96 in FIG. 6. Preferably, the welds 96 are substantially centered between faces 66 and 74 of the nozzle vanes 42. Although welds 96 are used in this particular embodiment, other means to secure the nozzle vanes 42 could be used. Additionally, the welds 96 could made at different locations, if needed or desired.

Next, the one end 64 of each nozzle vane 42 extending out from the opening 86 past the inner surface 78 of the inner endwall ring 46 and the other end 64 of each nozzle vane 42 extending out from the opening 86 past the outer surface 84 of the outer endwall ring 48 are machined by a turning procedure or shaved to form a tenon 44, as shown in FIGS. 4(*a–c*), 6, and 9. The portion of each end 64 of nozzle vane 42 which is turned (i.e. the portion on each side of tenon 44) is substantially flush with inner radial surface 78 on one end 64 and is also substantially flush with outer radial surface 84 on the other end 64 as shown in FIG. 6. The opposing sides 74 of each tenon 44 are substantially flush with the opposing faces 66 of each nozzle vane 42. Although in this particular embodiment, the nozzle vanes 42 are inserted in the openings 86 in the inner and outer endwall rings 46 and 48 before forming the tenons 44, the tenons 44 could be formed on the ends 64 of nozzle vanes 42 before they are inserted in the openings 86, if needed or desired. Once the tenons 44 are formed and the nozzle vanes 42 are in place in inner and outer endwall rings 46 and 48, the flowpath sub-assembly 98 is completed.

Accordingly, with the present invention, deep penetration welding is unnecessary because the tenons 44 in grooves 54, rather than the small welds 96, bear the pressure from the fluid flow when the turbine 56 is in operation. This eliminates the need for the labor intensive process of deep penetration welding reduces the cost and time of manufacturing the diaphragm assembly 40. Additionally, eliminating the deep penetration welds, eliminates the creation of welds which may divert fluid flow and detrimentally effect the performance of the turbine 56. Further, the nozzle vanes 42 are less likely to break off when the turbine 56 is in operation because the tenons 44 are better able to withstand the pressure from the fluid flow in the turbine 56 than the prior art deep penetration welds.

Next, the outer radial surface 92 of the inner retaining ring 50 and the inner radial surface 90 of the outer retaining ring 52 are turned to fit the shape of the flowpath sub-assembly 98 including the shape of the tenons 44 which results in circumferential grooves 54.

Figure 8:
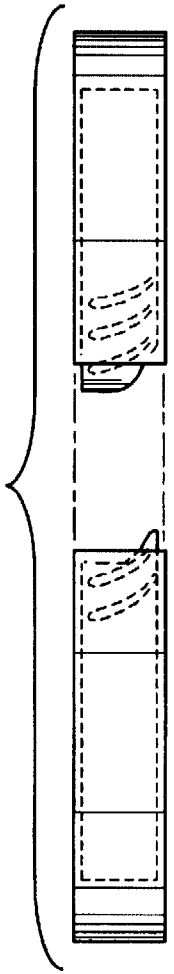
FIG. 8 is a partial, side view of the diaphragm assembly shown in FIG. 7.
Figure 7:
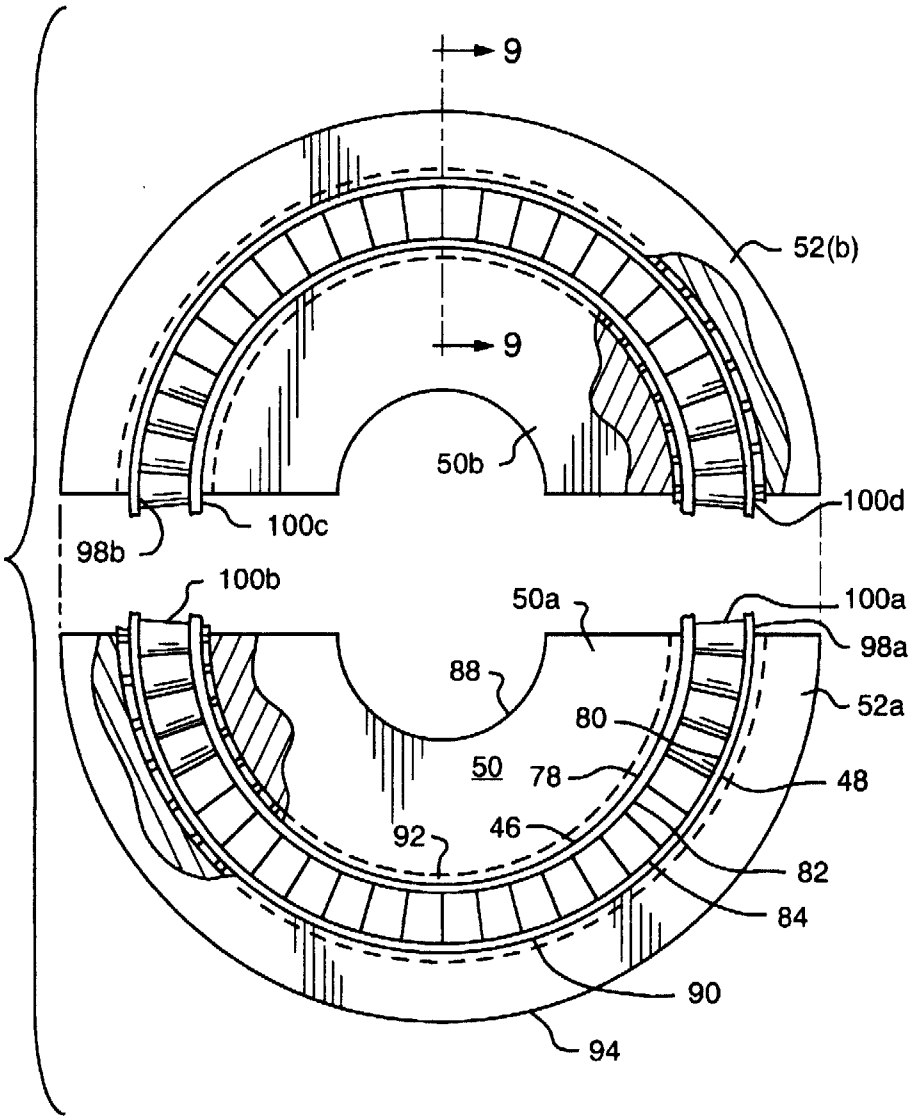
FIG. 7 is an axial, cross-sectional view of a diaphragm assembly.
Figure 10A:
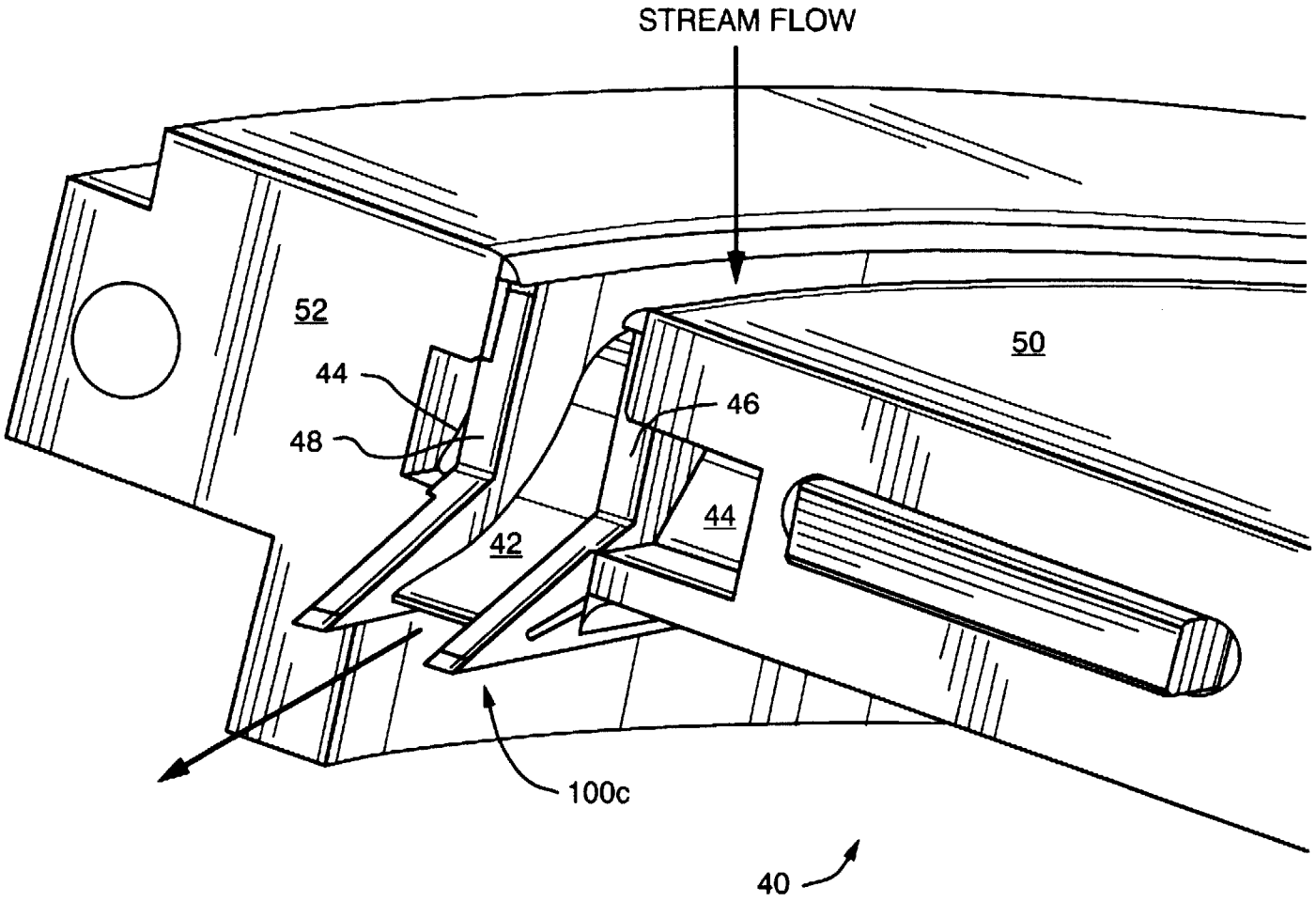
FIG. 10A is a perspective view of a portion of the diaphragm assembly at the split.
Figure 10B:
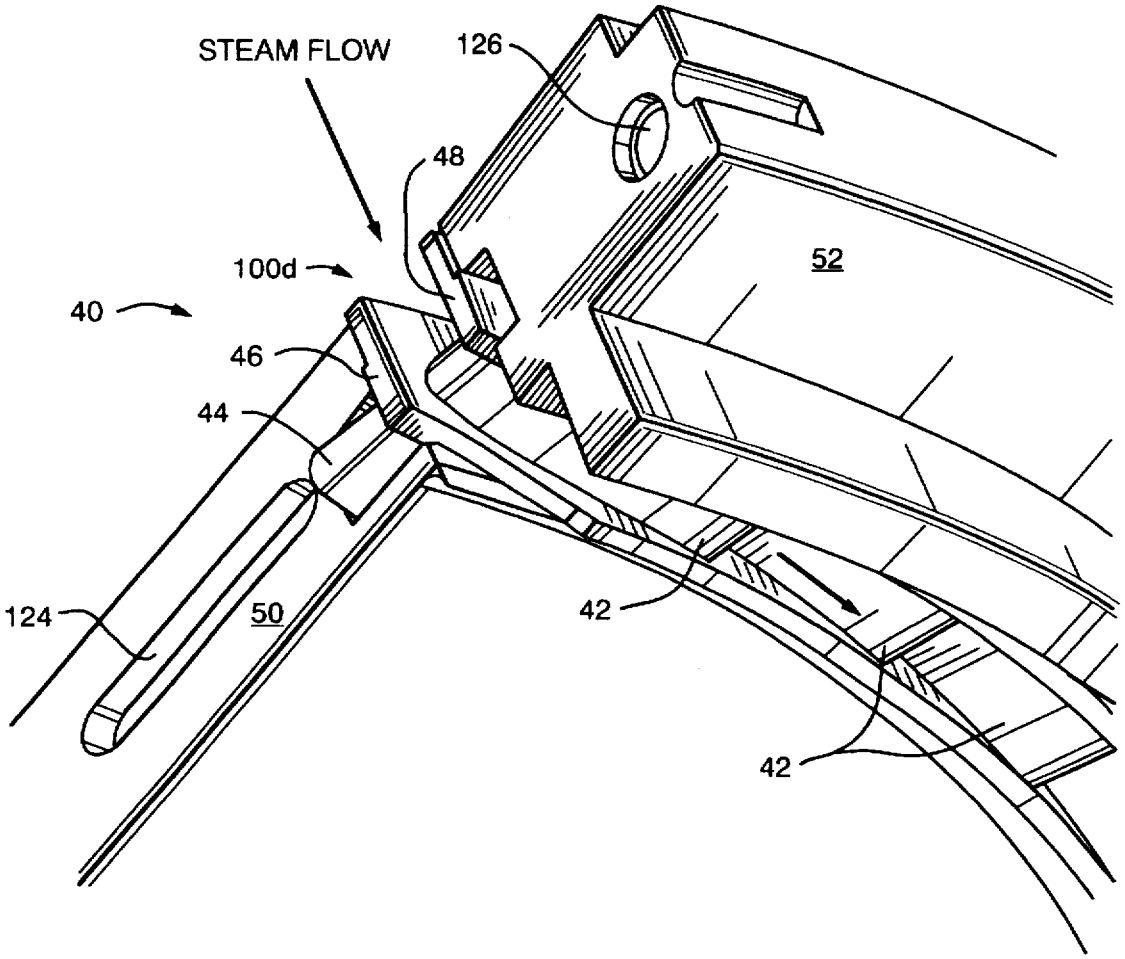
FIG. 10B is a perspective view of another portion of the diaphragm assembly at the split.

Once the grooves 54 are formed, the flowpath assembly 98 is spilt in half as shown in FIGS. 7, 8, 10A, and 10B. The inner and outer retaining rings 50 and 52 are split, substantially flat in an axial-radial plane while the flowpath sub-assembly 98, comprising the inner and outer endwall rings 46 and 48 with nozzle vanes 42 and tenons 44, are split along a line half way between adjacent nozzle vanes 42 at circumferentially opposite sites, as shown in FIGS. 8, 10A, and 10B. Each half of the flowpath sub-assembly 98(*a*) and 98(*b*)is offset circumferentially relative to the inner and outer retaining rings 50 and 52 so that a small amount of the flowpath sub-assembly 100(*a*)–100(*d*) extends circumferentially beyond the split line of the inner and outer retaining rings 50 and 52 and a matching amount is withdrawn at the other side of the diaphragm assembly 40 half. With the tenon 44 and groove 54 arrangement, the inner and outer endwall rings 46 and 48 with vanes 42 can be moved around the circumference of the inner surface of outer retaining ring 52 and of the outer surface of inner retaining ring 50 in grooves 54. Preferably, the circumferential extension of the flowpath sub-assembly extending past the split should be greater than 0.25 inches, but less than one percent of the circumference of the flowpath sub-assembly to minimize assembly difficulties. Because of the precise nature of the tenon 44 and groove 54 shapes, these circumferential extensions 100(*a*) –100(*d*) with the matching withdrawn areas form an effective radial alignment mechanism at the diaphragm assembly split when assembled with the other diaphragm assembly half. As shown in FIGS. 10A and 10B, rectangular and circular protuberances 120 and 122 are designed to mate with mating openings 124 and 126 to form an effective axial alignment mechanism. Although rectangular and circular protuberances 120 and 122 are shown, protuberances 120 and 122 and mating opening 124 and 126 can have other shapes as needed or desired.

The halves 50(*a*), 50(*b*), 52(*a*), and 52(*b*) are joined when portions 100(*a*)–100(*d*) are inserted or mated. Since the portion of the inner radial surface 78 of the inner endwall ring 46 which extends out past the split may bend in towards the center, the inner endwall ring 46 may need to be trimmed or chamfered on the inner radial surface 78 to align with the receiving inner circumferential groove 54. Preferably, this trimming is less than 0.020 inches.

Once the halves 50(*a*), 50(*b*), 52(*a*), and 52(*b*) are joined, the flowpath sub-assembly 98 is welded with a small seal weld to the inner and outer retaining rings 50 and 52 at surfaces 84 and 78 on the front 99 and back 100 faces of the diaphragm assembly 40. Small circumferential seal welds at the radial interface between the inner and outer endwall rings 46 and 48 and the inner and outer retaining rings 50 and 52 on the upstream and downstream faces of the diaphragm assembly 40 fixes the clocking of the flowpath relative to the retaining rings and eliminates the possibility of leakage around the flowpath.

While the invention has been shown in connection with specific embodiments, it is not intended to limit the invention to such embodiments, but rather the invention extends to all designs and modifications as come within the scope of the appended claims.

What is claimed is:

1. A turbine with an inlet casing, the turbine comprising:

an inner endwall ring having inner and outer radial surfaces and a plurality of openings extending radially through the inner endwall ring about its circumference;

an outer endwall ring having inner and outer radial surfaces and a plurality of openings extending radially through the outer endwall ring about its circumference;

a plurality of vanes, each of the vanes has two opposing ends;

a plurality of tenons, each of the tenons extends outwardly from one of the opposing ends of one of the vanes;

each of the vanes positioned between the inner and outer endwall rings, with one of the tenons protruding radially inward through one of the openings in the inner endwall ring and with the other tenon protruding radially outward through one of the openings in the outer endwall ring;

an inner retaining ring with inner and outer radial surfaces, the outer radial surface of the inner retaining ring having a first circumferential groove; and an outer retaining ring with inner and outer radial surfaces, the inner radial surface of the outer retaining ring having a second circumferential groove;

the portion of the tenons protruding radially inward through the openings in the inner endwall ring positioned in and resting substantially against each side of the first circumferential groove;

the portion of the tenons protruding radially outward through the openings in the outer endwall ring positioned in and resting substantially against each side of the second circumferential groove.

2. The assembly according to claim 1 wherein each of the vanes has a pair of opposing first faces and each of the tenons has a pair of opposing second faces which are substantially flush with each of the first faces.

3. The assembly according to claim 1 wherein the first and second circumferential grooves are continuous.

4. The assembly according to claim 1 wherein the first and second circumferential grooves each have a substantially rectangular cross-sectional shape and each of the tenons has a substantially rectangular cross-sectional shape.

5. A turbine diaphragm assembly comprising:

an inner endwall ring having inner and outer radial surfaces and a plurality of openings extending radially through the inner endwall ring about its circumference;

an outer endwall ring having inner and outer radial surfaces and a plurality of openings extending radially through the outer endwall ring about its circumference;

a plurality of vanes, each of the vanes has two opposing ends; and a plurality of tenons, each of the tenons extending outwardly from one of the opposing ends of one of the vanes, wherein each of the vanes has a pair of opposing faces and each of the tenons has a pair of opposing sides which are each substantially flush with one of the faces;

each of the vanes positioned between the inner and outer endwall rings, with one of the tenons protruding radially inward through one of the openings in the inner endwall ring and with the other tenon protruding radially outward through one of the openings in the outer endwall ring;

an inner retaining ring with inner and outer radial surfaces, the outer radial surface having a first circumferential groove; and an outer retaining ring with inner and outer radial surfaces, the inner radial surface having a second circumferential groove;

the inner radial surface of the inner endwall ring located adjacent to the outer radial surface of the inner retaining ring with the portion of the tenons protruding radially inward through the openings in the inner endwall ring positioned in the first circumferential groove;

the outer radial surface of the outer endwall ring located adjacent to the inner radial surface of the outer retaining ring with the portion of the tenons protruding radially outward through the openings in the outer endwall ring positioned in the second circumferential groove.

6. The assembly according to claim 5 wherein the first and second circumferential grooves are continuous.

7. The assembly according to claim 5 wherein the first and second circumferential grooves has a substantially rectangular shape and each of the tenons has a substantially rectangular shape.

8. The assembly according to claim 5 wherein each of the vanes has a pair of opposing first faces and each of the tenons has a pair of opposing second faces which are substantially flush with each of the first faces.

9. A turbine comprising:

a shaft which extends along and rotates about a central axis;

at least one rotor wheel mounted on and extending radially outward from the central axis to a radially outermost periphery;

at least one diaphragm assembly extending radially inward from an outer casing, the outer casing surrounding the rotor wheel and the diaphragm assembly, the diaphragm assembly axially spaced from the rotor wheel and configured to direct fluid against and effect rotation of the rotor wheel, each diaphragm assembly comprising:

an inner endwall ring having inner and outer radial surfaces and a plurality of openings extending radially through the inner endwall ring about its circumference;

an outer endwall ring having inner and outer radial surfaces and a plurality of openings extending radially through the outer endwall ring about its circumference;

a plurality of vanes, each of the vanes having two opposing ends;

a plurality of tenons, each of the tenons extends outwardly from one of the opposing ends of one of the vanes;

each of the vanes positioned between the inner and outer endwall rings, with one of the tenons protruding radially inward through one of the openings in the inner endwall ring and with the other tenon protruding radially outward through one of the openings in the outer endwall ring;

an inner retaining ring with inner and outer radial surfaces, the outer radial surface of the inner retaining ring having a first circumferential groove; and an outer retaining ring with inner and outer radial surfaces, the inner radial surface of the outer retaining ring having a second circumferential groove;

the portion of the tenons protruding radially inward through the openings in the inner endwall ring positioned in and resting substantially against each side of the first circumferential groove;

the portion of the tenons protruding radially outward through the openings in the outer endwall ring positioned in and resting substantially against each side of the second circumferential groove.

10. The assembly according to claim 9 wherein each of the vanes has substantially the same shape.

11. The assembly according to claim 9 wherein the first and second circumferential grooves are continuous.

12. The assembly according to claim 9 wherein the first and second circumferential grooves have a substantially rectangular shape and each of the tenons has a substantially rectangular shape.

13. A method of forming a diaphragm assembly comprising the steps of:

forming openings in an inner endwall ring, the openings extending through the inner endwall ring about its circumference, the inner endwall ring having inner and outer radial surfaces;

forming openings in an outer endwall ring, the openings extending through the outer endwall ring about its circumference, the outer endwall ring having inner and outer radial surfaces;

inserting a vane in each of the openings in the inner and outer endwall rings, each of the vanes having two opposing ends with one of the ends of each of the vanes extending from one of the openings in the inner endwall ring and with the other one of the ends of each of the vanes extending from one of the openings in the outer endwall ring;

turning each of the ends of each of the vanes to form a tenon, each of the tenons having substantially the same shape;

forming a first circumferential groove in an inner retaining ring, the inner retaining ring having inner and outer radial surfaces with the first circumferential groove in the outer radial surface;

forming a second circumferential groove in an outer retaining ring, the outer retaining ring having inner and outer radial surfaces with the second circumferential groove in the inner radial surface;

positioning the inner radial surface of the inner endwall ring adjacent to the outer radial surface of the inner retaining ring with the portion of the tenons protruding radially inward through the openings in the inner endwall ring positioned in the first circumferential groove; and positioning the outer radial surface of the outer endwall ring located adjacent to the inner radial surface of the outer retaining ring with the portion of the tenons protruding radially outward through the openings in the outer endwall ring positioned in the second circumferential groove.

14. The method according to claim 13 wherein each of the vanes has a pair of opposing faces and each of the tenons has a pair of opposing sides which are each substantially flush with one of the faces.

15. The method according to claim 13 wherein the first and second circumferential grooves are continuous.

16. The method according to claim 13 wherein the first and second circumferential grooves has a substantially rectangular shape and each of the tenons has a substantially rectangular shape.

17. A method for aligning two halves of a diaphragm assembly, each half of the diaphragm assembly comprising: half of an inner endwall ring having inner and outer radial surfaces and a plurality of openings extending radially through the inner endwall ring about its circumference; half of an outer endwall ring having inner and outer radial surfaces and a plurality of openings extending radially through the outer endwall ring about its circumference; a plurality of vanes, each of the vanes having two opposing ends; a plurality of tenons, each of the tenons having substantially the same shape and extending outwardly from one of the opposing ends of one of the vanes; each of the vanes positioned between the half of the inner and outer endwall rings, with one of the tenons protruding radially inward through one of the openings in the half of the inner endwall ring and with the other tenon protruding radially outward through one of the openings in the half of the outer endwall ring; the half of the inner and outer endwall rings with the vanes form half of a subassembly; half of an inner retaining ring with inner and outer radial surfaces, the outer radial surface of the inner retaining ring having half of a first circumferential groove; and half of an outer retaining ring with inner and outer radial surfaces, the inner radial surface of the outer retaining ring having half of a second circumferential groove; the inner radial surface of the half of the inner endwall ring located adjacent to the outer radial surface of the half of the inner retaining ring with the portion of the tenons protruding radially inward through the openings in the half of the inner endwall ring positioned in the half of the first circumferential groove; the outer radial surface of the half of the outer endwall ring located adjacent to the inner radial surface of the half of the outer retaining ring with the portion of the tenons protruding radially outward through the openings in the half of the outer endwall ring positioned in the half of the second circumferential groove, the method comprising:

rotating each of the halves of the subassembly to extend past one of the ends of the inner and outer retaining rings in each half of the diaphragm assembly;

mating the portions of the half of the subassembly in one half of the diaphragm assembly into the other half of the diaphragm assembly; and securing each half of the diaphragm assembly together.

18. The method for aligning two halves of a diaphragm assembly in accordance with claim 17, wherein the inner radial surface of the inner endwall ring adjacent to the ends of each half of the diaphragm assembly has a beveled edge.

* * * * *